US009734727B2

(12) United States Patent
Songa et al.

(10) Patent No.: US 9,734,727 B2
(45) Date of Patent: Aug. 15, 2017

(54) AIRCRAFT SYSTEMS AND METHODS TO DISPLAY MOVING LANDING PLATFORMS

(71) Applicant: HONEYWELL INTERNATIONAL INC., Morristown, NJ (US)

(72) Inventors: Anil Kumar Songa, Karnataka (IN); Sadguni Venkataswamy, Karnataka (IN); Sudheer B M, Karnataka (IN); Sandeep Alimi, Karnataka (IN)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 80 days.

(21) Appl. No.: 14/688,622

(22) Filed: Apr. 16, 2015

(65) Prior Publication Data

US 2016/0307450 A1 Oct. 20, 2016

(51) Int. Cl.
*G08G 5/02* (2006.01)
*G08G 5/00* (2006.01)

(52) U.S. Cl.
CPC ..... *G08G 5/025* (2013.01); *G08G 5/0013* (2013.01); *G08G 5/0021* (2013.01); *G08G 5/0047* (2013.01)

(58) Field of Classification Search
CPC combination set(s) only.
See application file for complete search history.

(56) References Cited

U.S. PATENT DOCUMENTS 6,114,975 A 9/2000 Guillard
8,155,806 B2 4/2012 Suddreth et al.
8,669,883 B2 3/2014 Paines
2007/0016371 A1 1/2007 Waid et al.
2010/0023189 A1* 1/2010 Suddreth ..... G01C 23/00 701/16
2014/0350754 A1 11/2014 Elgersma et al.

FOREIGN PATENT DOCUMENTS

DE 102008064712 B4 2/2013
IN 20120387111 8/2014

OTHER PUBLICATIONS

Ponirakis, L., "Advanced Helo Display for Zero-Zero Shipboard Landings," Shipboard automated launch and recovery system (SALRS) INP-LA Program, 2013.
Defence Research and Development Canada, "DRDC technology supports safer and smoother landings at sea for the Royal Canadian Navy," DRDC News Articles, 2014.

(Continued)

*Primary Examiner* — Kabir A Timory
(74) *Attorney, Agent, or Firm* — Lorenz & Kopf, LLP

(57) ABSTRACT

A display system for an aircraft includes a processing unit and a display device. The processing unit is configured to receive data representative of a landing platform on a movable carrier, and the data includes current energy parameters of the movable carrier. The processing unit is further configured to generate display commands associated with the landing platform and the energy parameters of the movable carrier. The display device is coupled the processing unit for receiving the display commands and operable to render first symbology representing the landing platform and second symbology representing the energy parameters of the movable carrier.

20 Claims, 7 Drawing Sheets

(56) References Cited

OTHER PUBLICATIONS

Doull D. et al., "Human factors in the design of Royal Navy Marine engineering equipment of the future," INEC 2002 : Sixth International Naval Engineering Conference and Exhibition : Conference Proceedings, 2002.
Donley, S. et al., "Helmet Mounted Display Symbology for Helicopter Landing on Small Ships,"Naval Air Development Center Warminster PA, 1981., p. 224, nonlinear scaling in final approach phase; specifically, quadratic scaling, 1981.
Takayuk et al., "Development of SH-60K Patrol Helicopter," Mitsubishi Heavy Industries, Ltd. Technical Review vol. 42 No. 5, 2005.
Extended EP Search Report for Application No. 16164133.7-1803 dated Sep. 9, 2016.
EP Examination Report for Application No. 16164133.7-1803 dated Nov. 4, 2017.

* cited by examiner

AIRCRAFT SYSTEMS AND METHODS TO DISPLAY MOVING LANDING PLATFORMS

TECHNICAL FIELD

The present invention generally relates to aircraft display systems and methods, and more particularly, to systems and methods for enhanced display of landing information.

BACKGROUND

Computer generated aircraft displays have become highly sophisticated and are used as primary flight displays to provide flight crews with real-time visual representations of flight management, navigation, and control information during flight in a single, readily interpretable display. As a result, such displays have become effective visual tools for controlling aircraft, reducing pilot workload, increasing situational awareness, and improving overall flight safety.

Landing is typically the most demanding aspect of flight. During the landing approach, the pilot must evaluate if the aircraft may safely land or if the landing attempt should be aborted. The landing operation may be further complicated when the landing platform is moving, such as is common when an aircraft lands on a ship. Although conventional display systems provide various types of information about the landing environment, it may be necessary for the pilot during the landing operation to mentally consider and adjust for the relative motion of the landing platform.

Accordingly, it is desirable to provide systems and methods with additional and/or more convenient flight information on an aircraft visual display, particularly during a landing operation. Furthermore, other desirable features and characteristics of the present invention will become apparent from the subsequent detailed description of the invention and the appended claims, taken in conjunction with the accompanying drawings and this background of the invention.

BRIEF SUMMARY

In accordance with an exemplary embodiment, a display system for an aircraft includes a processing unit and a display device. The processing unit is configured to receive data representative of a landing platform on a movable carrier, and the data includes current energy parameters of the movable carrier. The processing unit is further configured to generate display commands associated with the landing platform and the energy parameters of the movable carrier. The display device is coupled the processing unit for receiving the display commands and operable to render first symbology representing the landing platform and second symbology representing the energy parameters of the movable carrier.

In accordance with another exemplary embodiment, a method is provided for displaying landing information with an aircraft display system. The method includes receiving data representative of a landing platform on a movable carrier from the movable carrier, the data including current energy parameters of the movable carrier; generating, with a processing unit, display commands associated with the landing platform and the energy parameters of the movable carrier; and displaying, on a display device based on the display commands, first symbology representing the landing information and second symbology representing the energy parameters of the movable carrier.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Broadly, exemplary embodiments described herein provide visual display systems and methods for aircraft. More specifically, the display systems and methods provide additional and/or more convenient landing information superimposed with other navigation and control information when approaching a landing platform, particularly a movable platform. In one exemplary embodiment, the landing information may represent or otherwise provide symbology associated with the movement of the landing platform.

Figure 1:
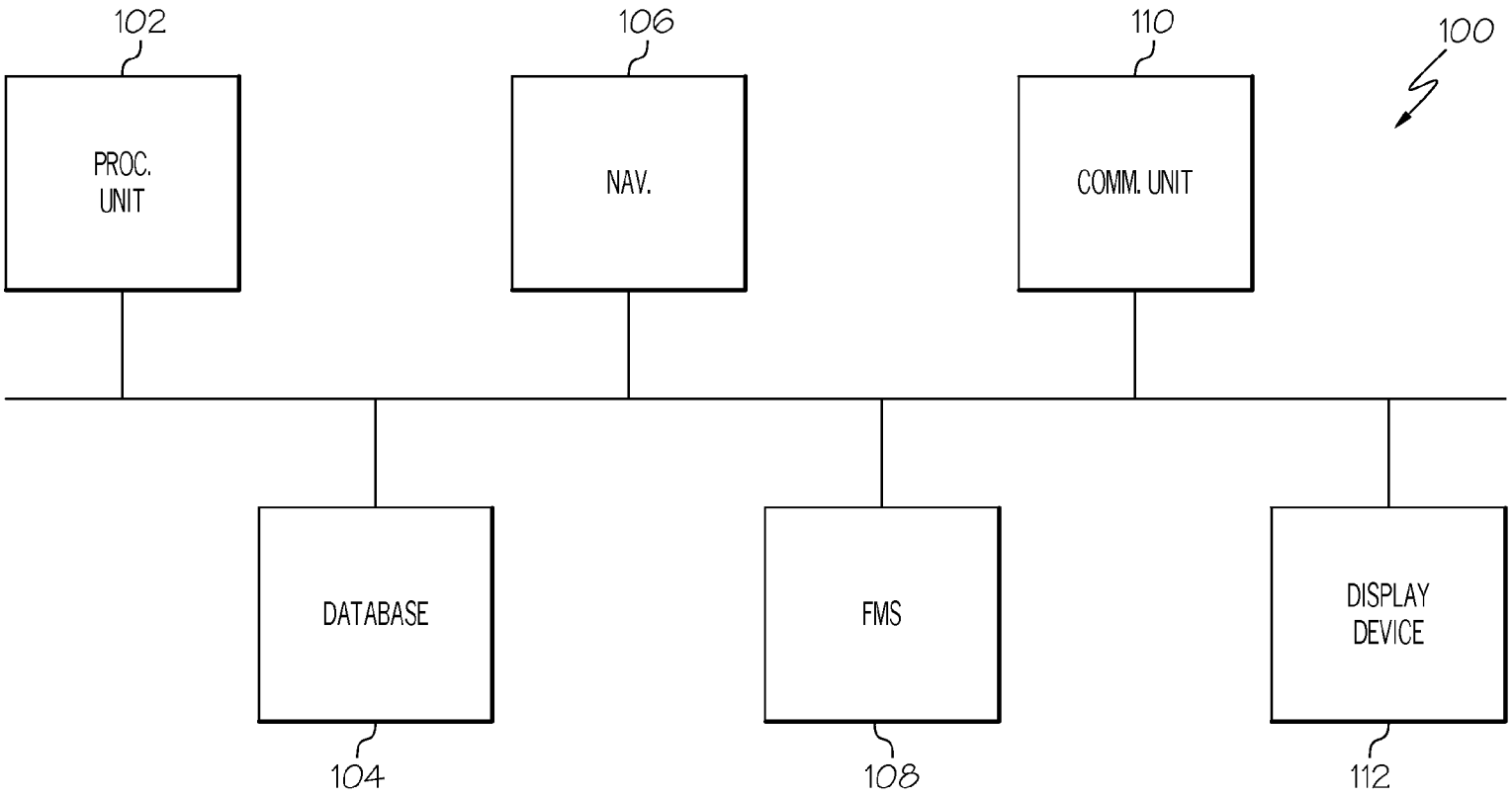
FIG. 1 is a functional block diagram of an aircraft display system in accordance with an exemplary embodiment.

FIG. 1 is a block diagram of an aircraft display system 100 in accordance with an exemplary embodiment. It should be understood that FIG. 1 is a simplified representation of the system 100 for purposes of explanation and ease of description. Further exemplary embodiments of the system 100 may include additional, other devices and components for providing further functions and features. As described below, the system 100 is typically utilized during flight to enhance the type and/or visibility of pertinent information for a user (e.g., a pilot or flight crew) during a landing situation.

The system 100 can be utilized in an aircraft, such as a helicopter, airplane, or unmanned vehicle. Moreover, exemplary embodiments of the system 100 can also be utilized in spacecraft, ships, submarines, and other types of vehicles. For simplicity, exemplary implementations are described below with reference to "aircraft." In one exemplary embodiment, the system 100 is particularly useful during a landing operation in which the aircraft is approaching a landing platform that may be moving. For example, landing platforms on ships or other types of carriers may be moving in one or more horizontal directions, but also subject to changes in pitch, roll, yaw, and elevation (e.g., changes in the vertical direction). Although such landing platforms are typically associated with ships, the exemplary embodiments discussed below are applicable to any type of land, water, or air landing platforms that are moving or movable relative to a fixed location. In the discussion below, the term "landing platform" refers to any type of landing location (e.g., a landing pad or runway), and the term "carrier" refers to any type of base or structure (e.g., a ship, vessel, and/or air or land platform) associated with the landing platform.

As shown in FIG. 1, the system 100 includes a processing unit 102, a database 104, a navigation system 106, a flight management system 108, a communications unit 110, and a display device 112 coupled together in any suitable manner, such with as a data bus. Although the system 100 appears in FIG. 1 to be arranged as an integrated system, the system 100 is not so limited and can also include an arrangement whereby one or more aspects of the system 100 are separate components or subcomponents of another system located either onboard or external to the aircraft. Each component is introduced below prior to a more detailed description of particular features of the system 100 described in conjunction with FIGS. 2-8.

The processing unit 102 may be a computer processor associated with a primary flight display or other aircraft display. In one exemplary embodiment, the processing unit 102 functions to at least receive and/or retrieve aircraft flight management information (e.g., from the flight management system 108), navigation and control information (e.g., from the navigation system 106), and landing, target and/or terrain information (e.g., from the database 104 and/or communications unit 110). As introduced above and discussed in further detail below, the processing unit 102 additionally calculates and generates display commands representing the flight environment, particularly the landing environment. The processing unit 102 then sends the generated display commands to display device 112 for presentation to the user. More specific functions of the processing unit 102 will also be discussed below.

Depending on the embodiment, the processing unit 102 may be implemented or realized with a general purpose processor, a content addressable memory, a digital signal processor, an application specific integrated circuit, a field programmable gate array, suitable programmable logic device, discrete gate or transistor logic, processing core, discrete hardware components, or any combination thereof. In practice, the processing unit 102 includes processing logic that may be configured to carry out the functions, techniques, and processing tasks or methods associated with operation of the system 100.

Although not shown, the processing unit 102 may include a user interface coupled to the processing unit 102 to allow a user to interact with the display device 112 and/or other elements of the system 100. The user interface may be realized as a keypad, touchpad, keyboard, mouse, touch panel, joystick, knob, line select key or another suitable device adapted to receive input from a user. In some embodiments, the user interface may be incorporated into the display device 112, such as a touchscreen. In further embodiments, the user interface is realized as audio input and output devices, such as a speaker, microphone, audio transducer, audio sensor, or the like.

Database 104 is coupled to processing unit 102 and can be a memory device (e.g., non-volatile memory, disk, drive, tape, optical storage device, mass storage device, etc.) that stores digital landing, waypoint, target location, target structure information, and terrain data as either absolute coordinate data or as a function of aircraft position that enables the construction of a synthetic representation of the aircraft operating environment. Database 104 can additionally include other types of navigation and/or operational information relating to the evaluation and display of landing lighting information. For example, database 104 may include safety margins or parameters that provide guidance for evaluating a flight situation, such as during a landing situation. In some embodiments, database 104 includes data associated with landing platform and the corresponding carriers, as described in greater detail below. Data in the database 104 may be uploaded prior to flight or received from external sources during flight. In one exemplary embodiment, landing information is received via the communications unit 110 from the carrier on which the aircraft intends to land.

The navigation system 106 is configured to provide the processing unit 102 with real-time navigational data and/or information regarding operation of the aircraft. The navigation system 106 may include or cooperate with a global positioning system (GPS), inertial reference system (IRS), Air-data Heading Reference System (AHRS), or a radio-based navigation system (e.g., VHF omni-directional radio range (VOR) or long range aid to navigation (LORAN)). The navigation system 106 is capable of obtaining and/or determining the current state of the aircraft, including the location (e.g., latitude and longitude), altitude or above ground level, airspeed, pitch, glide scope, heading, and other relevant flight information.

The flight management system 108 supports navigation, flight planning, and other aircraft control functions, as well as provides real-time data and/or information regarding the operational status of the aircraft. The flight management system 108 may include or otherwise access one or more of the following: a weather system, an air traffic management system, a radar system, a traffic avoidance system, an autopilot system, an auto-thrust system, a flight control system, hydraulics systems, pneumatics systems, environmental systems, electrical systems, engine systems, trim systems, lighting systems, crew alerting systems, electronic checklist systems, an electronic flight bag, and/or other suitable avionics systems. As examples, the flight management system 108 may identify operating states of the aircraft, such as, engine operation and current aircraft configuration status, including information such as the current flap configuration, aircraft speed, aircraft pitch, aircraft yaw, aircraft roll, and the like. Additionally, the flight management system 108 may identify or otherwise determine environmental conditions at or near the current location of the aircraft, such as, for example, the current temperature, wind speed, wind direction, atmospheric pressure, and turbulence. The flight management system 108 may also identify optimized speeds, distance remaining, time remaining, cross track deviation, navigational performance parameters, and other travel parameters.

The communications unit 110 may be any suitable device for sending and receiving information to and from the aircraft system 100. In some embodiments, communications unit 110 may be configured to receive radio frequency transmissions, satellite communication transmissions, optical transmissions, laser light transmissions, sonic transmissions or transmissions of any other wireless form of data link.

In one exemplary embodiment, the communications unit 110 is configured to send and/or receive information from the carrier on which the aircraft is preparing to land. For example, this carrier information may include information about the carrier itself, such as position, attitude, pseudorange, and carrier measurements and characteristics. The carrier information further includes information about the landing platform, such as the dimensions, status, identifications, markings, lighting, safety margins, height, obstacles, procedures, and the like. Additionally, the carrier information may include energy parameters (e.g., the kinematic state, energy profile, or other characterizations of movement) associated with the carrier, including the direction, speed, pitch, roll, and energy trends, profile, and intentions. The carrier information may be retrieved and/or sent from, for example, a carrier-based inertial unit, automatic dependent surveillance broadcast (ADSB), or other suitable source. As such, the communications unit 110 is configured to receive and interpret this information from the carrier. In some exemplary embodiments, the system 100 may derive this information from sources other than the communications unit 110, such as by tracking or monitoring the carrier. In one exemplary embodiment, the information received from the carrier via an ADSB or inertial unit may provide a greater range than other sources of such information. As described below, the communications unit 110 provides this information to the processing unit 102 for consideration as part of the visual display presented to the operator during the landing operation.

The system 100 also includes the display device 112 coupled to the processing unit 102. The display device 112 may include any device or apparatus suitable for displaying various types of computer generated symbols and flight information discussed above. In various exemplary embodiments, the rendered image may be a two-dimensional lateral view, a two-dimensional vertical profile view, or a three-dimensional perspective view. Any suitable type of display medium capable of visually presenting multi-colored or monochrome flight information for a pilot or other flight crew member can be provided, such as, for example, various types of CRT displays, LCDs, OLED displays, plasma displays, projection displays, HDDs, HUDs, and the like.

Accordingly, the system 100 functions to present an image or display to the user on the display device 112 that represents the environment surrounding the aircraft as well as various types of navigation and control information. As described below, the system 100 is particularly suitable for providing information to the user during a landing operation, including information associated with the landing platform and/or the respective carrier. During operation, the landing platform on which the user intends to land may be selected by the user (e.g., via the user interface) or derived from a flight plan (e.g., via the navigation system 106 or flight management system 108). In particular, the processing unit 102 generates display commands for the display device 112 to render landing symbology associated with the landing platform of the carrier that represents the real-life appearance of the target landing platform. Further, the landing symbology may represent the energy parameters of the landing platform and carrier, as also described below. In some instances, the processing unit 102 may evaluate the energy parameters in view of safety margins (e.g., from the database 104) and generate an alert when one or more of the energy parameters exceed the safety margins. As such, the system 100 considers the energy parameters from the moving or movable landing platform and aligns or otherwise evaluates these energy parameters with respect to the aircraft, including aircraft energy parameters, to result in symbology that assists the operator during landing. Exemplary displays or images rendered by the system 100 upon approaching the target landing platform are described in greater detail below.

FIGS. 2-8 are visual displays or portions of displays 200, 400, 500, 650, 750, 850 rendered by the system 100 on the display device 102 in accordance with exemplary embodiments. FIG. 1 may be referenced below in the discussion of FIGS. 2-8. Generally, the visual displays or portions of displays 200, 400, 500, 650, 750, 850 include includes exemplary textual, graphical, and/or iconic information rendered by the display device 112 in response to appropriate display commands from the processing unit 102, as described above. Although various examples of symbology are described below and depicted in FIGS. 2-8, other types and variations of symbology may be presented.

Figure 2:
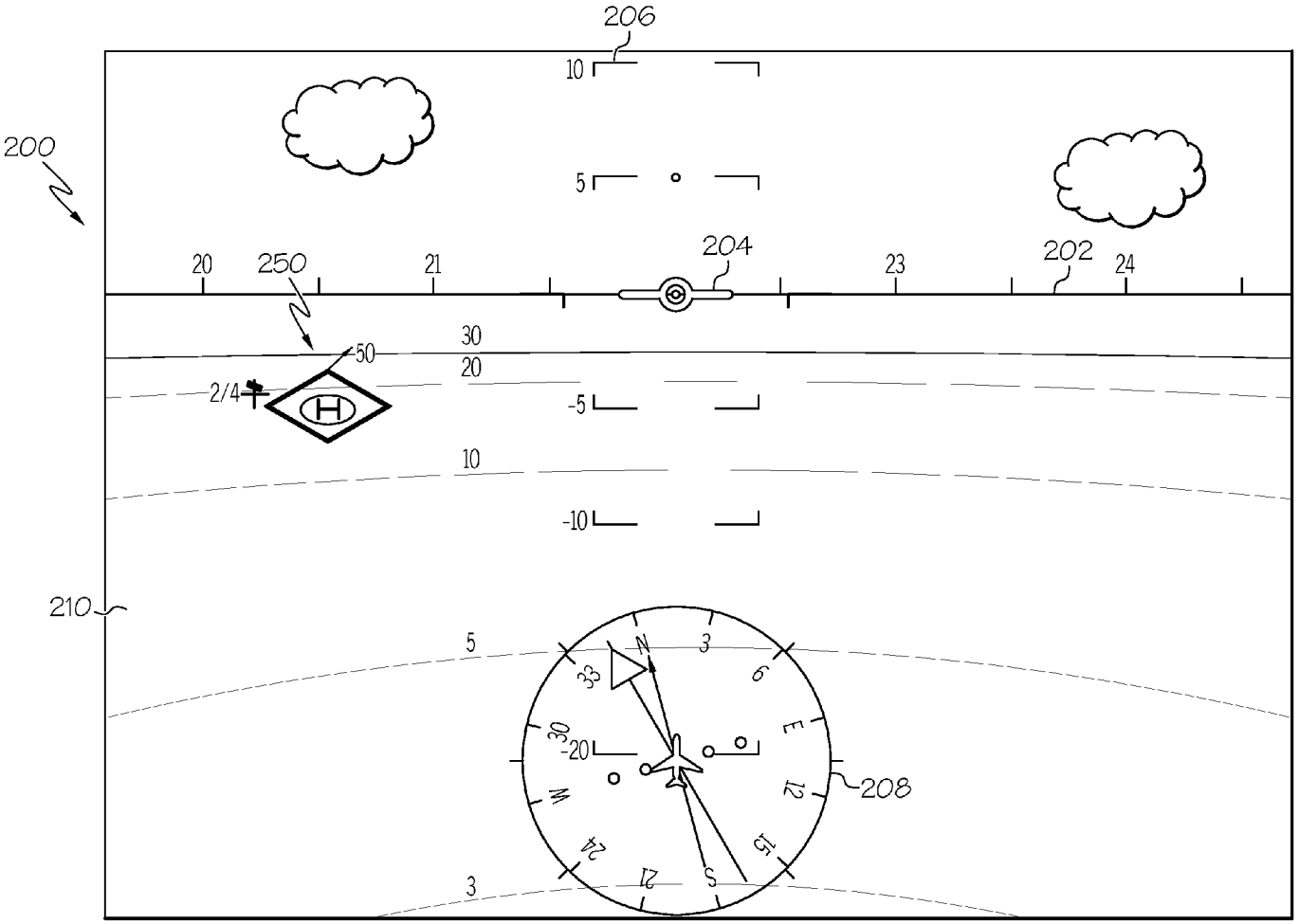
FIG. 2 is a visual display rendered by the aircraft display system of FIG. 1 in accordance with an exemplary embodiment.

As shown, FIG. 2 depicts an exemplary visual display 200 in the form of a three-dimensional synthetic perspective view of the real-time aircraft operating environment of the type presented on a primary flight display. In the depicted exemplary embodiment, the display 200 shows, among other things, computer generated symbols representing a zero pitch reference line (e.g., commonly referred to as a horizon line) 202, a flight path marker (also known as a flight path vector or velocity vector) 204, attitude indicator 206, horizontal situation indicator 208, and terrain (e.g., identified generally as element 210). Generally, the terrain 210 can include any representation of the environment surrounding the aircraft, including other aircraft or ships. Additional information may be provided on the display 200, including additional or alternative indicators representing heading, airspeed, altitude, bank angles, vertical speed, throttle, and flap and gear positions. Although the display 200 is shown as an egocentric, first-person frame of reference, the display 200 can be a secondary, wingman, and/or plan or perspective view that enables a viewer to view the aircraft, as well as zoom in and out.

In the situation depicted on the visual display 200 of FIG. 2, the aircraft is flying over water and intends to land on a landing platform of a carrier. Since the carrier may be moving, the intended landing platform may also be subject to movement. As will now be described in more detail, the display 200 also selectively renders landing information 250 that increases the situational awareness of the operator when landing on a moving landing platform.

As noted above, the landing information 250 is generally associated with a target or intended landing platform on a carrier. Typically, the carrier is depicted on the visual display 200 in a form representative of the actual appearance of the carrier, similar to other portions of the environment. In some embodiments, the size of symbology representing the landing information 250 may be a function of the distance of the target platform from the aircraft. For example, at least portions of the landing information 250 represent the actual appearance of the landing platform, such as in a manner proportional to the actual size relative to the other aspects of the landing environment. However, in some scenarios, the landing information 250 may be presented in a scale that is larger than an actual representation of the landing platform. In other words, at relatively large distances, the landing information 250 is depicted with an exaggerated scale. As such, the landing information 250 may be rendered on the visual display 200 in a size that enables the user to suitably evaluate the information. Further, the landing information 250 can be modified as the aircraft approaches such that the symbology representing real life aspects of the landing platform is gradually reduced until reaching a 1:1 scale with the surrounding environment. In the view of FIG. 2, the aircraft is at a distance from the carrier such that the landing information 250 obscures any visual depiction of the carrier, which in this scenario is a ship.

Figure 3:
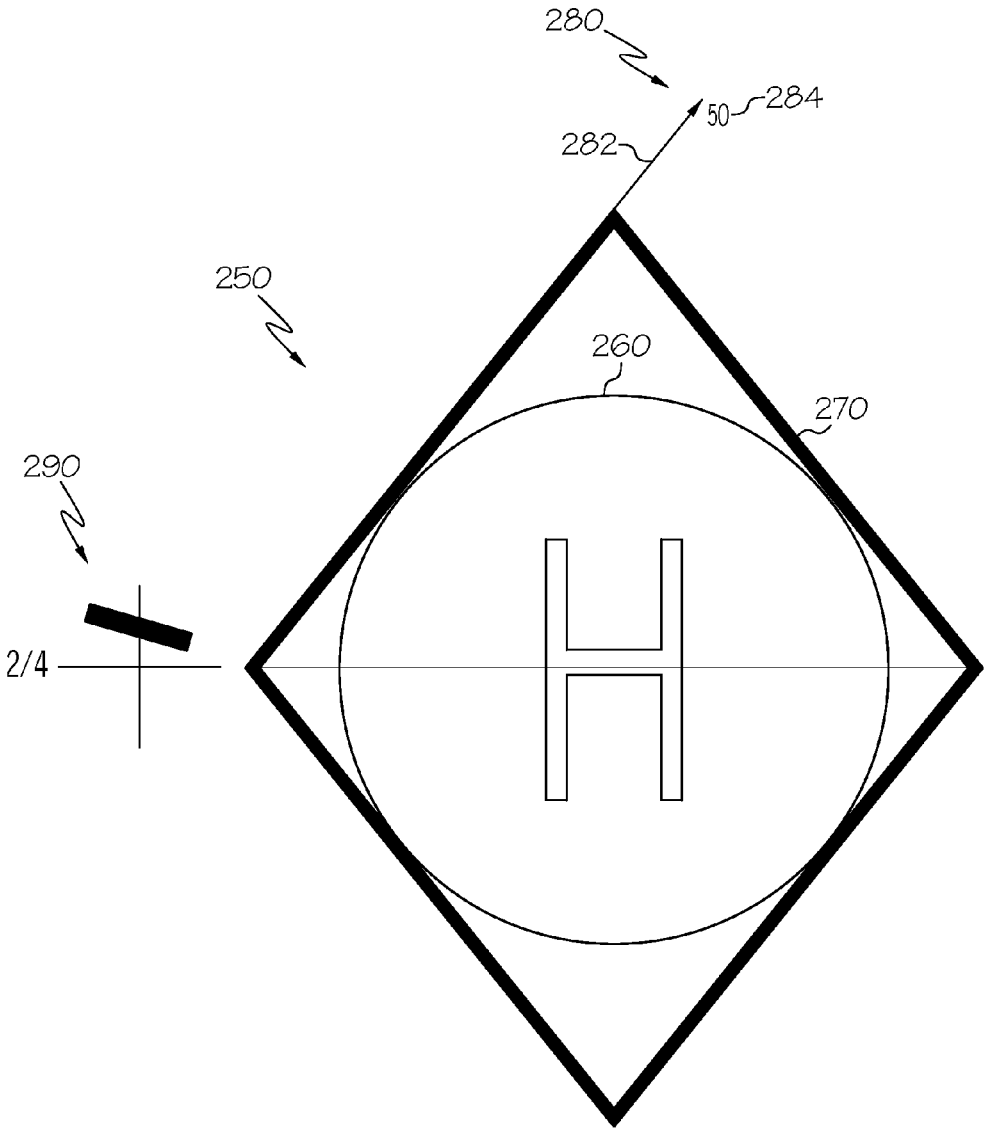
FIG. 3 is a more detailed portion of the visual display of FIG. 2 in accordance with an exemplary embodiment.

FIG. 3 is a closer view of the landing information 250 from FIG. 2. As described below, the landing information 250 may include various aspects and characteristics to assist the operator with landing on a moving or movable platform.

In one exemplary embodiment, the landing information 250 may include symbology for the landing platform 260 that accurately represents the actual landing platform on the individual carrier, including any applicable marking or shapes. As such, in the depicted embodiment, the landing platform 260 is a conformal, circular shaped landing pad, although other shapes and configurations can be provided. As also shown, symbology representing the landing platform 260 also includes markings in the form of an "H" symbol, which in this situation indicates that the landing platform 260 is intended for helicopters and provides a reference for alignment or orientation. As appropriate, additional lighting or markings corresponding to the touchdown and liftoff area (TLOF) and/or final approach and takeoff area (FATO) may be represented. As noted above, this information may be provided to the system 100 from the carrier, e.g., from the inertial unit of the carrier. As such, the landing information 250, including the landing platform 260, is presented in a manner that is specific to the individual carrier. This is beneficial considering that characteristics of landing platforms vary from carrier to carrier.

The landing information 250 further includes symbology representing the energy parameters of the carrier, and particularly, that the landing platform is moving or movable. In the depicted embodiment, the movement (or energy parameters) symbology includes a diamond outline 270 surrounding the landing pad 260 that indicates that the landing platform is movable or moving. Other shapes may be provided to represent the movable nature of the landing pad 260.

The landing information 250 may further include additional information regarding the nature of the motion of the landing platform. In particular, speed symbology 280 may be rendered as part of the landing information 250. In the depicted exemplary embodiment, the speed symbology 280 includes an arrow 282 representing the direction of the carrier and a magnitude of the speed 284 ("50" in the depicted example) of the carrier. In one exemplary embodiment, the direction arrow 282 and speed magnitude 284 are provided in a form that indicates the motion of the carrier relative to the motion of the aircraft. In other exemplary embodiments, the speed symbology 280 may be provided in absolute terms.

In one exemplary embodiment, the speed symbology 280 is positioned at the apex of the diamond outline 270. In other embodiments, the speed symbology 280 may be positioned in other locations. For example, in one exemplary embodiment, the position of the speed symbology 280 may be a function of the speed characteristics of the carrier relative to the aircraft. For example, if the carrier is moving away from the aircraft, the speed symbology 280 is positioned on the apex of the diamond outline 270 such that the arrow 282 points away from the aircraft. However, if the carrier is moving toward the aircraft, the speed symbology 280 may be positioned on the bottom of the diamond outline 270 such that the arrow 282 may point towards the aircraft. In further embodiments, the position of the speed symbology 280 may be rendered independently from the diamond outline 270.

The landing information 250 may further include attitude (or pitch/roll) symbology 290 immediately adjacent to or superimposed on the landing platform 260. In this exemplary embodiment, the attitude symbology 290 to positioned on the left side of the diamond outline 270 and provides information regarding the pitch and roll of the carrier. In particular, the attitude symbology 290 includes symbology indicating the nature of the information and a numerical representation of the magnitude of the pitch and roll. In the depicted example, the pitch is provided as 2° and the roll is provided as 4°.

As such, the landing information 250 typically includes movement symbology (e.g., diamond outline 270, speed symbology 280, and attitude symbology 290) and symbology representing the landing platform 260. Generally, the movement symbology is presented immediately adjacent to or otherwise superimposed on the landing platform 260 such that the information may be immediately evaluated and considered by the user in a manner than minimizes attention diversion.

As noted above, this information may be provided to the system 100 from the carrier, e.g., from the inertial unit of the carrier. As such, the landing platform 260 and movement symbology (e.g., diamond outline 270, speed symbology 280, attitude symbology 290) are presented in a manner that is specific to the individual carrier and the individual situation. This is beneficial considering that different carriers may have different responses in similar situations, for example, as a result of variations in size, hull design, stabilization system, etc.

Figure 4:
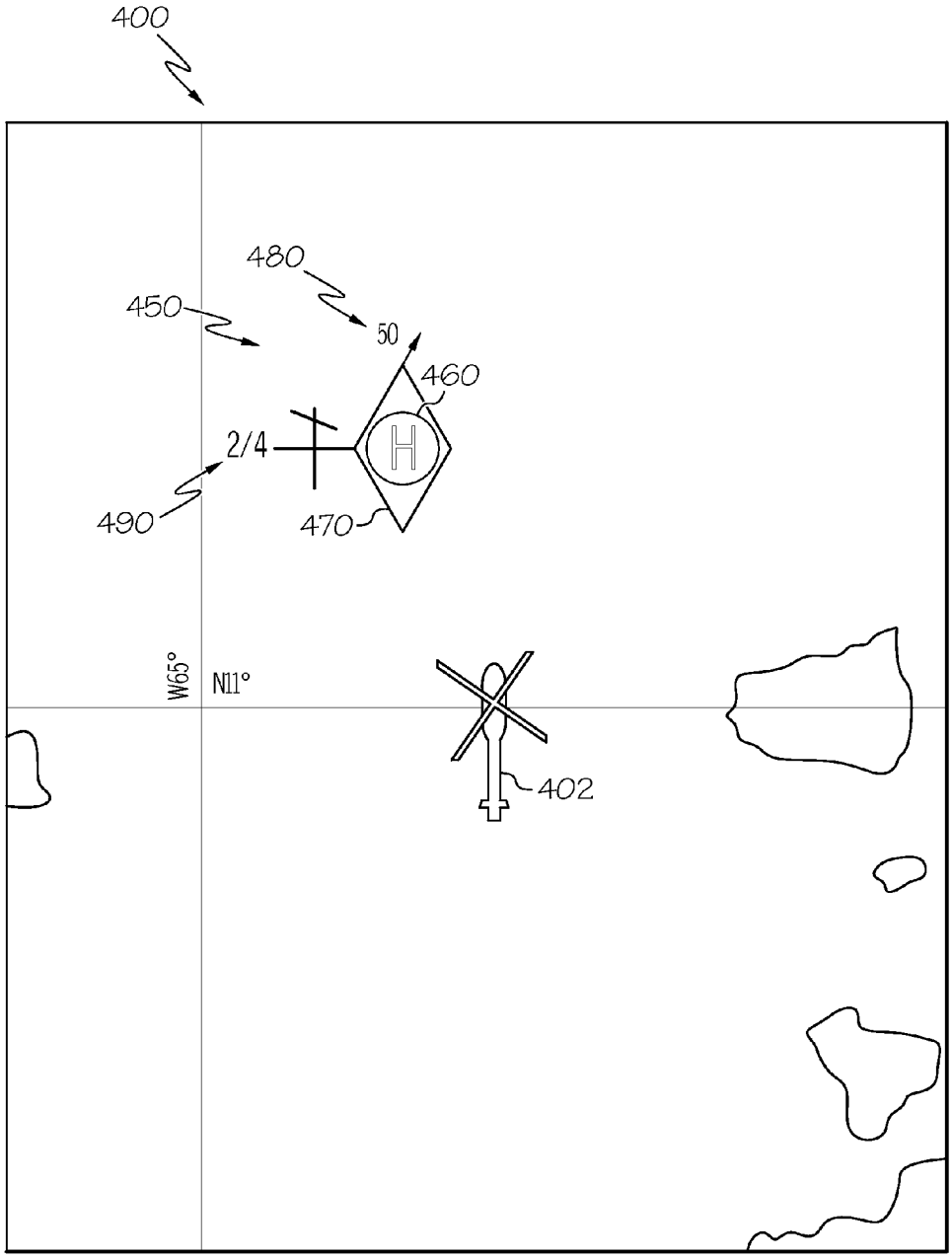
FIG. 4 is another visual display rendered by the aircraft display system of FIG. 1 in accordance with an exemplary embodiment.

FIG. 4 is another exemplary visual display 400 that may be rendered by the aircraft system 100 of FIG. 1 in accordance with an exemplary embodiment. In particular, the visual display 400 of FIG. 4 is a plan view of the aircraft, represented by symbology 402, relative to the surrounding environment. As in FIGS. 2 and 3, FIG. 4 additionally depicts landing symbology 450 representing a target landing platform on a carrier. In particular, the landing symbology 450 may include the landing platform 460 and movement symbology in the form of the diamond outline 470, speed symbology 480, and attitude symbology 490, each of which are described above.

Figure 5:
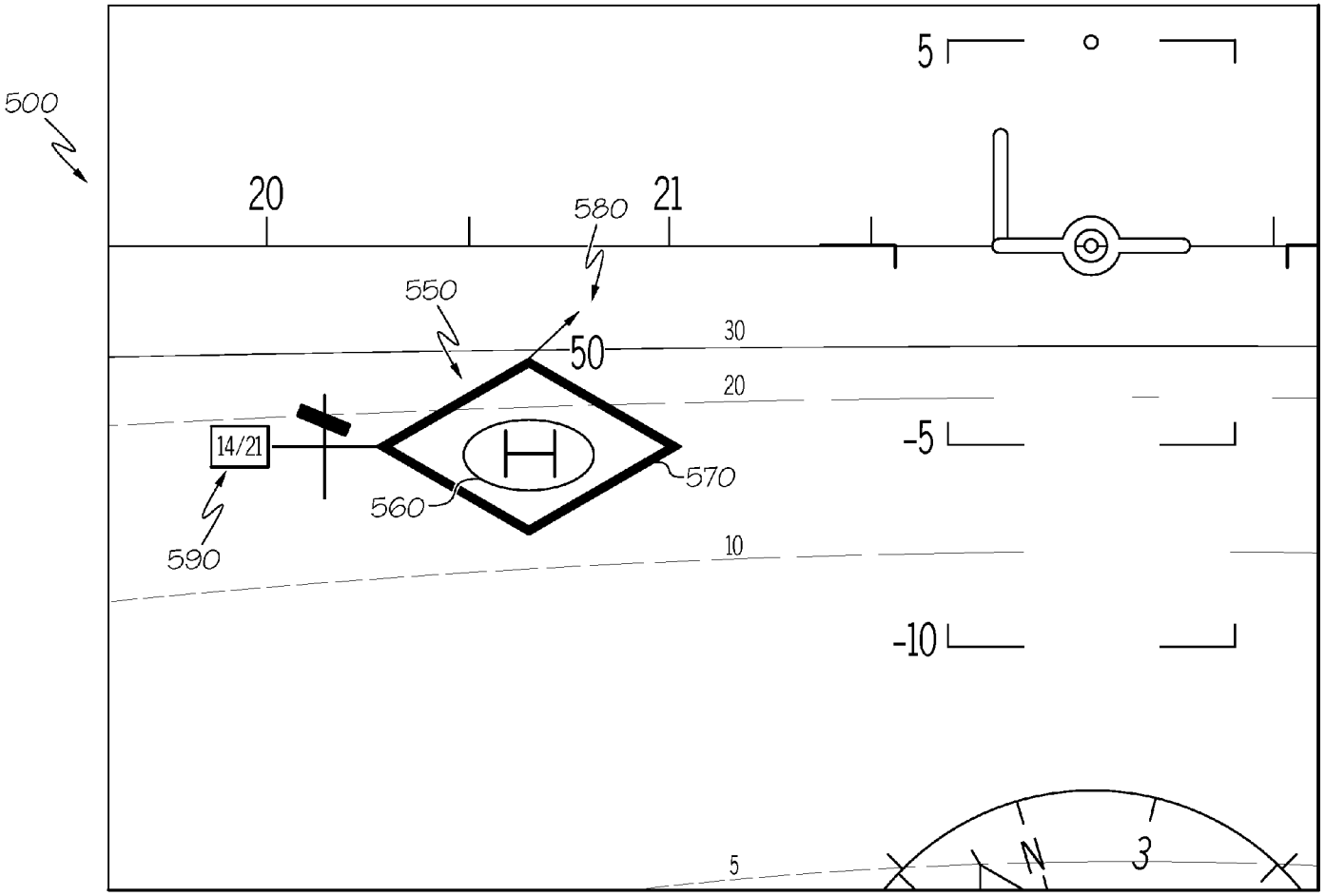
FIG. 5 is a further visual display rendered by the aircraft display system of FIG. 1 in accordance with an exemplary embodiment.

FIG. 5 is a further exemplary visual display 500 that may be rendered by the aircraft system 100 of FIG. 1 in accordance with an exemplary embodiment. The display 500 of FIG. 5 is similar to the three-dimensional synthetic perspective view of the type shown in FIG. 2 and depicts landing symbology 550 representing a target carrier, including the landing platform 560 and movement symbology in the form of the diamond outline 570, speed symbology 580, and attitude symbology 590.

In accordance with an exemplary embodiment, the system 100 may consider the safety margins of the carrier and/or the aircraft during the landing situation when displaying the landing symbology 550. For example, in the situation of FIG. 5, the pitch and roll have relatively high magnitudes (e.g., 14° and 25°), as indicated by the attitude symbology 590, and may unsuitable for continuing the landing operation. In such a scenario, the landing symbology 550 may include a warning, such as a change in color of the attitude symbology 590 (e.g., from a neutral color to a warning color, such as yellow or red). Other alerts may be provided, including other types of visual alerts and/or audio alerts.

To generate these warnings, the system 100 may consider the current or predicted energy profile of the carrier and the current or predicted energy profile of the aircraft as relative or absolute parameters. These energy parameters may be compared to applicable safety margins or guidance, and if the energy parameters exceed the margins, the system 100 generates the suitable warning. The safety margins may be determined from any suitable source and stored in database 104, as an example. In one exemplary embodiment, the safety margins may be provided by a government or industry group or the carrier itself that, as an example, details the conditions (e.g., wind speed, wind direction, pitch, roll) that are acceptable for a particular type or model of aircraft to safely land.

Figure 6:
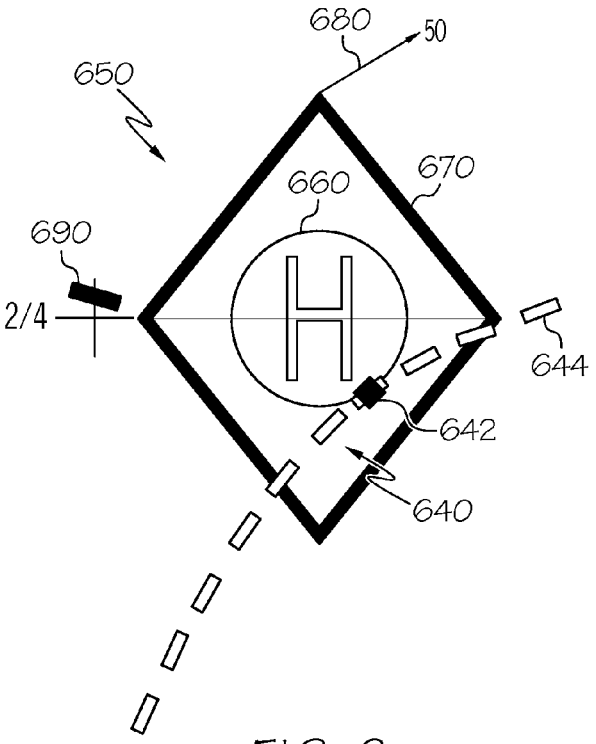
FIGS. 6-8 depict additional examples of landing symbology rendered by the aircraft display system of FIG. 1 in accordance with an exemplary embodiment.
Figure 7:
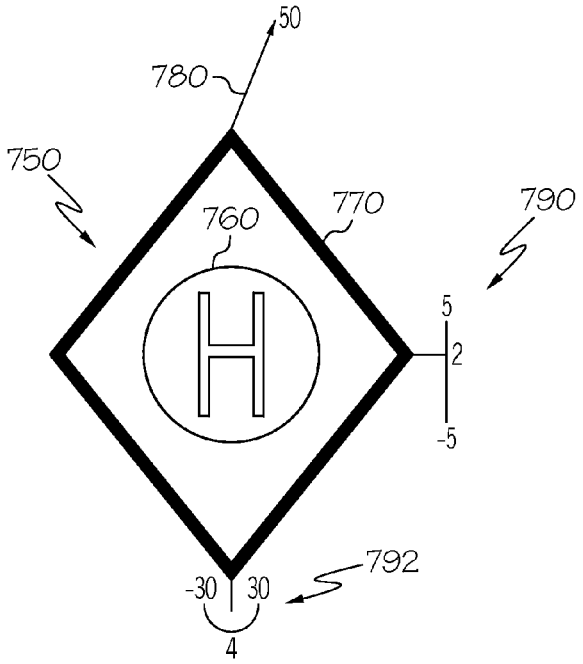
Figure 8:
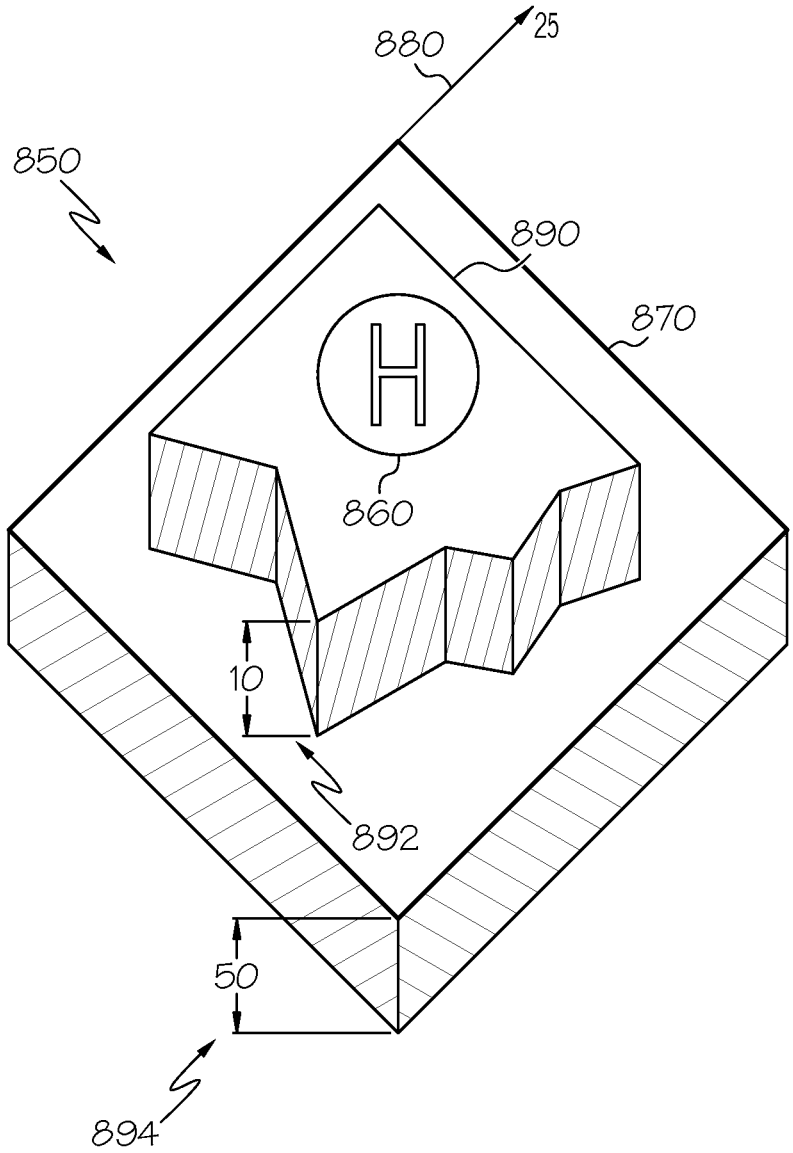

FIGS. 6-8 are examples of additional or alternative types of landing information 650, 750, 850 that generated by the system 100 of FIG. 1 in accordance with an exemplary embodiment. Generally, the landing information 650, 750, 850 discussed below may be used in conjunction with or in lieu of the other examples of landing information discussed above.

For example, FIG. 6 is landing information 650 that includes symbology representing the landing platform 660 and movement symbology in the form of the diamond outline 670, speed symbology 680, and attitude symbology 690. The landing information 650 further includes intersection symbology 640. In particular, the intersection symbology 640 provides an indication of the location or position 642 at which the aircraft will intersect or converge with the landing platform 660. This position 642 may be determined from a number of factors, including the energy profiles of the carrier and aircraft, environmental or weather factors, and the structural characteristics of the carrier, such as railings and obstructions that require a particular approach path. Additionally, or in the alternative, the intersection symbology 640 may include an indication of the predicted path 644 of the aircraft relative to the carrier and, as above, may be based on the current or anticipated energy profiles of the aircraft and carrier.

FIG. 7 is landing information 750 that includes symbology representing the landing platform 760 and movement symbology in the form of the diamond outline 770, speed symbology 780, and attitude symbology 790, 792. In this exemplary embodiment, the attitude symbology is separated into pitch symbology 790 and roll symbology 792. As shown, the pitch symbology 790 may be positioned to one side of the landing platform 760 and provides a numerical representation of the current pitch (e.g., 2°) and a scale representation of the maximum and minimum pitch (e.g., 5° to −5°). In one exemplary embodiment, the maximum and minimum pitch may represent the applicable safety margins for the aircraft to land, as discussed above. As such, the current pitch may be displayed in the appropriate position on the scale to provide an intuitive visual representation of the current pitch in the context of maximum and minimum pitch. The pitch symbology 790 may further have dynamic properties to represent changes to the current pitch. For example, the scale may move up and down relative to the fixed current pitch to indicate the updated pitch in the context of the scale, or the position of the current pitch may move up and down relative to the fixed scale.

As also shown, the roll symbology 792 may be positioned above or below the landing platform 760 and provide a numerical representation of the current roll (e.g., 4°) and a scale representation of the maximum and minimum roll angles (e.g., 30° to −30°). As such, the current roll angle may be displayed in the appropriate position on the scale to provide an intuitive visual representation of the current roll angle in the context of maximum and minimum angle associated with the applicable safety margins. The roll symbology 792 may further have dynamic properties to represent the changes to the current roll. For example, the scale may pivot clockwise or counter-clockwise relative to the fixed current roll to indicate the updated roll in the context of the scale, or the position of the current roll may pivot relative to the fixed scale.

FIG. 8 is landing information 850 that includes symbology representing the landing platform 860 and movement symbology in the form of the diamond outline 870 and speed symbology 880. In this exemplary embodiment, the landing information 850 further includes symbology representing the physical or structural nature of the carrier.

In particular, the landing information 850 includes symbology that represents the landing structure 890. The symbology for the landing structure 890 may represent various types of information, including the shape of the landing structure, the size and position of the landing structure relative to the carrier, and the size and position of the landing platform relative to the landing structure. The landing information 850 may include symbology that additionally represents the height 892 of the landing structure 890 from the deck or primary surface of the carrier. In the depicted exemplary embodiment, the height 892 is provided in numerical value. In other embodiments, the numerical value may be omitted and the height 892 (or merely the elevated nature of the structure 890) may be represented by the three-dimensional nature of the landing structure 890. In further exemplary embodiments, the landing structure 890 may be depicted in a two-dimensional or plan view and the height 892 may be represented by a numerical value or omitted.

Additionally, the landing information 850 may include symbology that represents the height 894 of the main or primary surface relative to the terrain or underlying surface (e.g., the ground or water level, depending on the carrier). In the depicted exemplary embodiment, the height 894 includes a numerical value, while in other embodiments, the nature (and/or presence) of the height 894 is provided by the three-dimensional representation of the outline 870. In further exemplary embodiments, the landing information 850 may be depicted in a two-dimensional or plan view such that the height 894 may be represented by a numerical value or omitted.

Accordingly, the enhanced display of the landing information can provide important information in a more convenient position for the pilot for easy recognition and evaluation. As such, during an approach and/or landing operation, the pilot can concentrate on the landing information without detracting attention from the navigation and control. This can reduce pilot workload and navigation and control errors, improve performance consistency, and increase flight safety. Warnings, including the use of colors and other type of alerts, may be provided to further enhance pilot awareness. The exemplary embodiments discussed above are particular useful in landing on a carrier in an ocean environment, which may otherwise provide challenging operating conditions with respect to wind and wake turbulence during landing and takeoff.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A display system for an aircraft, comprising:

a processing unit configured to receive data representative of a landing platform of a movable carrier, the data including current energy parameters of the movable carrier, the processing unit further configured to generate display commands associated with the landing platform and the energy parameters of the movable carrier, wherein the energy parameters include a current speed of the movable carrier relative to the aircraft; and a display device coupled to the processing unit for receiving the display commands and operable to render first symbology representing the landing platform and second symbology representing the energy parameters of the movable carrier, wherein the second symbology includes at least an indication of the current speed of the movable carrier relative to the aircraft.

2. The display system of claim 1, wherein the second symbology includes a diamond shape surrounding the first symbology.

3. The display system of claim 1, wherein the energy parameters include a current motion direction of the movable carrier, and wherein the second symbology includes an arrow oriented in the current motion direction of the movable carrier.

4. The display system of claim 1, wherein the second symbology includes a numerical value of the current speed of the movable carrier relative to the aircraft.

5. The display system of claim 1, wherein the energy parameters include a current pitch of the movable carrier relative to the aircraft, and wherein the second symbology includes the current pitch of the movable carrier.

6. The display system of claim 5, wherein the energy parameters include a current roll of the movable carrier relative to the aircraft, and wherein the second symbology further includes the current roll of the movable carrier.

7. The display system of claim 6, wherein the second symbology further includes a pitch scale on which the current pitch is positioned and a roll scale on which the current roll is positioned.

8. The display system of claim 1, wherein the display device is configured to render a three-dimensional synthetic view of a flight environment that includes the first and second symbology.

9. The display system of claim 1, wherein the display device is a primary flight display.

10. The display system of claim 1, wherein the display device is configured to render a plan view of a flight environment that includes the first and second symbology.

11. The display system of claim 1, further comprising a communications unit coupled to the processing unit and configured to receive the data representative of the landing platform on the movable carrier collected by an inertial unit of the movable carrier.

12. The display system of claim 1, wherein the processing unit is configured to evaluate the energy parameters and generate an alert when at least one of the energy parameters exceeds a predetermined safety margin, and wherein the second symbology represents the alert.

13. The display system of claim 1, wherein the processing unit is configured to evaluate the energy parameters of the movable carrier and determine an intersection location between the landing platform and the carrier, and wherein the second symbology represents the intersection location.

14. The display system of claim 1, wherein the data further includes a height associated with the landing platform, and wherein the first symbology includes a representation of the height.

15. A method of displaying landing information with an aircraft display system, comprising:

receiving data representative of a landing platform, the landing platform being located on a movable carrier, from the movable carrier, the data including current energy parameters of the movable carrier, wherein the energy parameters include at least one of a current motion direction of the movable carrier relative to the aircraft, a current pitch of the movable carrier relative to the aircraft, or a current roll of the movable carrier relative to the aircraft;

generating, with a processing unit, display commands associated with the landing platform and the energy parameters of the movable carrier; and displaying, on a display device based on the display commands, first symbology representing the landing information and second symbology representing the energy parameters of the movable carrier, wherein the second symbology includes at least an indication of at least one of the current motion direction of the movable carrier relative to the aircraft, the current pitch of the movable carrier relative to the aircraft, or the current roll of the movable carrier relative to the aircraft.

16. The method of claim 15, wherein the displaying step includes displaying a three-dimensional synthetic view of a flight environment that includes the first and second symbology.

17. The method of claim 15, wherein the energy parameters include the current motion direction of the movable carrier relative to the aircraft, and wherein the displaying step includes displaying the second symbology with an arrow oriented in the current motion direction of the movable carrier.

18. The method of claim 15, wherein the energy parameters include the current pitch and the current roll of the movable carrier relative to the aircraft, and wherein the displaying step includes displaying the second symbology with the current pitch and current roll of the movable carrier.

19. The method of claim 15, further comprising evaluating the energy parameters of the movable carrier in view of a predetermined safety margin, generating an alert when at least one of the energy parameters exceeds the predetermined safety margin, and displaying the alert with the second symbology.

20. The method of claim 15, further comprising evaluating the energy parameters of the movable carrier and determining an intersection location of the aircraft with the landing platform, and displaying the intersection location on the display device with the second symbology.

* * * * *